US009194267B2

(12) United States Patent
Loman

(10) Patent No.: US 9,194,267 B2
(45) Date of Patent: Nov. 24, 2015

(54) ARRANGEMENT FOR INTRODUCING A LIQUID MEDIUM INTO EXHAUST GASES FROM A COMBUSTION ENGINE

(75) Inventor: Peter Loman, Sollentuna (SE)

(73) Assignee: SCANIA CV AB (SE)

( * ) Notice: Subject to any disclaimer, the term of this patent is extended or adjusted under 35 U.S.C. 154(b) by 30 days.

(21) Appl. No.: 13/823,985

(22) PCT Filed: Oct. 4, 2011

(86) PCT No.: PCT/SE2011/051178

§ 371 (c)(1), (2), (4) Date: Mar. 15, 2013

(87) PCT Pub. No.: WO2012/047159

PCT Pub. Date: Apr. 12, 2012

(65) Prior Publication Data

US 2013/0167516 A1 Jul. 4, 2013

(30) Foreign Application Priority Data

Oct. 6, 2010 (SE) ..... 1051048

(51) Int. Cl.
*F01N 5/04* (2006.01)
*F01N 3/10* (2006.01)
(Continued)

(52) U.S. Cl.
CPC ..... *F01N 3/10* (2013.01); *B01F 3/04049* (2013.01); *B01F 5/0062* (2013.01);
(Continued)

(58) Field of Classification Search
CPC ..... F01N 3/10; F01N 3/2892; F01N 3/2066; F01N 2240/20; F01N 2610/02; F01N 2610/1453; B01F 5/0062; B01F 5/0451; B01F 3/04049
USPC ..... 60/286, 295, 316, 317, 320, 375–324, 60/319, 297
See application file for complete search history.

(56) References Cited

U.S. PATENT DOCUMENTS

2008/0087013 A1* 4/2008 Crawley et al. ..... 60/320
2008/0250776 A1 10/2008 Brown et al.
(Continued)

FOREIGN PATENT DOCUMENTS

DE 42 03 807 A1 8/1993
DE 10 2006 015964 A1 10/2007
(Continued)

OTHER PUBLICATIONS

International Search Report dated Jan. 12, 2012 issued in corresponding International patent application No. PCT/SE2011/051178.
(Continued)

*Primary Examiner* — Audrey K Bradley
*Assistant Examiner* — Kelsey Stanek
(74) *Attorney, Agent, or Firm* — Ostrolenk Faber LLP

(57) ABSTRACT

Arrangement for introducing a liquid medium into exhaust gases from a combustion engine, comprising a mixing duct, a first flow guide for creating a first exhaust vortex in the mixing duct such that the exhaust gases in this first exhaust vortex rotate in a first direction of rotation during their movement downstream in the mixing duct, an injector for injecting the liquid medium in the form of a finely divided spray into exhaust gases which are led into the liquid medium in an exhaust flow at the center of the first vortex, and a second flow guide for creating a second exhaust vortex in the mixing duct concentrically with and externally about the first vortex, such that the exhaust gases in this second vortex rotate in a second direction of rotation, which is opposite to said first direction of rotation, during their movement downstream in the mixing duct.

7 Claims, 2 Drawing Sheets

(51) Int. Cl.

| | |
|---|---|
| ***F01N 3/28*** | (2006.01) |
| ***B01F 5/00*** | (2006.01) |
| ***B01F 5/04*** | (2006.01) |
| ***B01F 3/04*** | (2006.01) |
| *F01N 3/20* | (2006.01) |

(52) U.S. Cl.
CPC ..... *B01F 5/0451* (2013.01); *F01N 3/2892* (2013.01); *F01N 3/2066* (2013.01); *F01N 2240/20* (2013.01); *F01N 2610/02* (2013.01); *F01N 2610/1453* (2013.01)

(56) References Cited

U.S. PATENT DOCUMENTS

2010/0005790 A1 1/2010 Zhang
2011/0308234 A1* 12/2011 De Rudder et al. ..... 60/295

FOREIGN PATENT DOCUMENTS

| | | | | |
|---|---|---|---|---|
| DE | 10 2008 029110 | A1 | | 12/2009 |
| GB | 2 381 218 | | | 4/2003 |
| GB | 2381218 | A | * | 4/2003 |
| WO | WO 2007/115748 | A1 | | 10/2007 |

OTHER PUBLICATIONS

International Preliminary Report on Patentability dated Jan. 17, 2013 issued in corresponding International patent application No. PCT/SE2011/051178.

* cited by examiner

ARRANGEMENT FOR INTRODUCING A LIQUID MEDIUM INTO EXHAUST GASES FROM A COMBUSTION ENGINE

The present application is a 35 U.S.C. §§371 national phase conversion of PCT/SE2011/051178, filed Oct. 4, 2011, which claims priority of Swedish Application No. 1051048-5, filed Oct. 6, 2010, the contents of which are incorporated by reference herein. The PCT International Application was published in the English language.

BACKGROUND OF THE INVENTION

1. Field of the Invention

The present invention relates to an arrangement for introducing a liquid medium, e.g. urea, into exhaust gases from a combustion engine.

2. Related Art

To meet prevailing exhaust cleaning requirements, today's motor vehicles are usually provided with a catalyst in the exhaust line to effect catalytic conversion of environmentally hazardous constituents of the exhaust gases to environmentally less hazardous substances. A method which has been employed for achieving effective catalytic conversion is based on injecting a reducing agent into the exhaust gases upstream of the catalyst. A reductive substance which forms part of, or is formed by, the reducing agent is carried by the exhaust gases into the catalyst and is adsorbed on active seats in the catalyst, resulting in accumulation of the reductive substance in the catalyst. The accumulated reductive substance may then react with and thereby convert an exhaust substance to a substance with less environmental impact.

Such a reduction catalyst may for example be of the SCR (selective catalytic reduction) type. This type of catalyst is hereinafter called an SCR catalyst. An SCR catalyst reduces $NO_x$ in the exhaust gases.

In the case of an SCR catalyst, a reducing agent in the form of urea solution is usually injected into the exhaust gases upstream of the catalyst. The injection of urea into the exhaust gases results in the formation of ammonia which then serves as the reductive substance which assists the catalytic conversion in the SCR catalyst. The ammonia accumulates in the catalyst by being adsorbed on active seats in the catalyst, and $NO_x$ present in the exhaust gases is converted to nitrogen gas and water when it is brought into contact in the catalyst with accumulated ammonia on the active seats in the catalyst.

When urea is used as the reducing agent, it is injected into the exhaust line in the form of a liquid urea solution via an injector. The injector comprises a nozzle via which the urea solution is injected under pressure into the exhaust line in the form of a finely divided spray. In many operating conditions of a diesel engine, the exhaust gases will be at a high enough temperature to be able to vaporise the urea solution so that ammonia is formed.

It is difficult, however, to avoid part of the urea solution supplied coming into contact with and becoming attached to the internal wall surface of the exhaust line in an unvaporised state. The exhaust line, which is often in contact with and cooled by surrounding air, will be at a lower temperature than the exhaust gases within the exhaust line. When a combustion engine is run in a uniform way for a period of time, i.e. during steady-state operating conditions, no appreciable variations in the exhaust flow occur and the urea solution injected into the exhaust gases will therefore be focused on substantially the same region of the exhaust line throughout said period of time. The relatively cool urea solution may cause local lowering of the temperature in that region of the exhaust line, which may lead to the formation in that region of a film of urea solution which is then entrained by the exhaust flow. When this film has moved a certain distance in the exhaust line, the water in the urea solution will boil away under the influence of the hot exhaust gases. Solid urea will remain and be slowly vaporised by the heat in the exhaust line. If the supply of solid urea is greater than the amount vaporised, solid urea will accumulate in the exhaust line. If the resulting layer of urea becomes thick enough, the urea and its decomposition products will react with one another to form urea-based primitive polymers known as urea lumps. Such urea lumps may over time block an exhaust line.

It is therefore desirable that the injected urea solution be widely spread out in the exhaust gases so that it is prevented from concentrating in substantially the same region of the exhaust line. A good spread of the urea solution in the exhaust gases also facilitates its vaporisation. It is also desirable that the injected urea solution be broken up into as small drops as possible, since the vaporisation rate increases with decreasing drop size.

An arrangement of this type is already known from WO 2007/115748 A1. In that known arrangement a first exhaust flow is led into a mixing duct in such a way that the exhaust gases in this first exhaust flow are caused to rotate about the centreline of the mixing duct, resulting in an exhaust vortex in the mixing duct. An injection means is provided to inject a liquid medium into a tubular injection chamber, thereby bringing the injected medium into contact with a second exhaust flow which passes through the injection chamber. The mixture of exhaust gases and injected medium formed within the injection chamber is then led into the mixing duct at the centre of said exhaust vortex in order to achieve good distribution of the liquid medium in the exhaust gases.

SUMMARY OF THE INVENTION

Further improvements are desirable in the type of arrangement described above, in order to-develop a configuration which in at least some aspects affords an advantage compared therewith.

According to an embodiment of the present invention, such an advantage may be achieved by an arrangement which comprises:

- a mixing duct arranged to have exhaust gases flowing through it,
- a first flow guide configured for creating a first exhaust vortex in the mixing duct, which first flow guide is configured to cause the exhaust gases in this first exhaust vortex to rotate in a first direction of rotation during their movement downstream in the mixing duct,
- an injector for injecting the liquid medium in the form of a finely divided spray into the exhaust gases, which are led into the mixing duct in an exhaust flow at the centre of the first exhaust vortex, and
- a second flow guide configured for creating a second exhaust vortex in the mixing duct concentrically with and externally about the first exhaust vortex, which second flow guide is configured to cause the exhaust gases in this second exhaust vortex to rotate in a second direction of rotation, which is opposite to said first direction of rotation, during their movement downstream in the mixing duct.

In this type of arrangement, the first exhaust vortex helps to centrifuge the liquid medium radially outwards so that it comes into contact with the second exhaust vortex. The fact that the first exhaust vortex and the second exhaust vortex rotate in opposite directions results in very turbulent flow where they come into contact with one another. This turbulent flow helps to spread out the liquid medium in the exhaust gases. The resulting small drops of liquid medium are thus well spread out in the exhaust gases in the mixing duct before they have occasion to reach any wall surface of the duct, thereby eliminating or at least substantially reducing the risk of the previously mentioned lump formation. The turbulent flow also helps to break the drops of liquid medium into smaller drops which are more quickly vaporised.

According to an embodiment of the invention, the injector is configured to inject the liquid medium into an injection chamber situated upstream of the mixing duct, which chamber is arranged to have exhaust gases flowing through it and is connected to the mixing duct in such a way that the exhaust gases received in the injection chamber are led into the mixing duct in an exhaust flow at the centre of the first exhaust vortex. In the injection chamber, an initial spreading of the liquid medium in a first portion of the exhaust gases takes place before the liquid medium comes into contact with the vortices in the mixing duct.

According to another embodiment of the invention, the injection chamber is bounded radially by a casing which is provided with throughflow apertures distributed round its circumference to allow exhaust gases to enter the injection chamber via these apertures. The exhaust flow through the casing apertures pushes the medium injected in the injection chamber towards the centre of the chamber so that it is prevented from reaching its wall surfaces.

According to another embodiment of the invention, the arrangement comprises a third flow guide configured for creating a third exhaust vortex in the mixing duct concentrically with and externally about the second exhaust vortex, which third flow guide is configured to cause the exhaust gases in the third exhaust vortex to rotate in said first direction of rotation during their movement downstream in the mixing duct. The fact that the second exhaust vortex and the third exhaust vortex rotate in opposite directions results in very turbulent flow where they come into contact with one another. This turbulent flow contributes to further spreading out of the liquid medium in the exhaust gases and further breaking up of the drops.

Other advantageous features of the arrangement according to these embodiments are indicated by the description set out below.

BRIEF DESCRIPTION OF THE DRAWINGS

The invention is described below in more detail on the basis of exemplary embodiments thereof, with reference to the attached drawings, in which.

DETAILED DESCRIPTION OF EMBODIMENTS OF THE INVENTION

Figure 1:
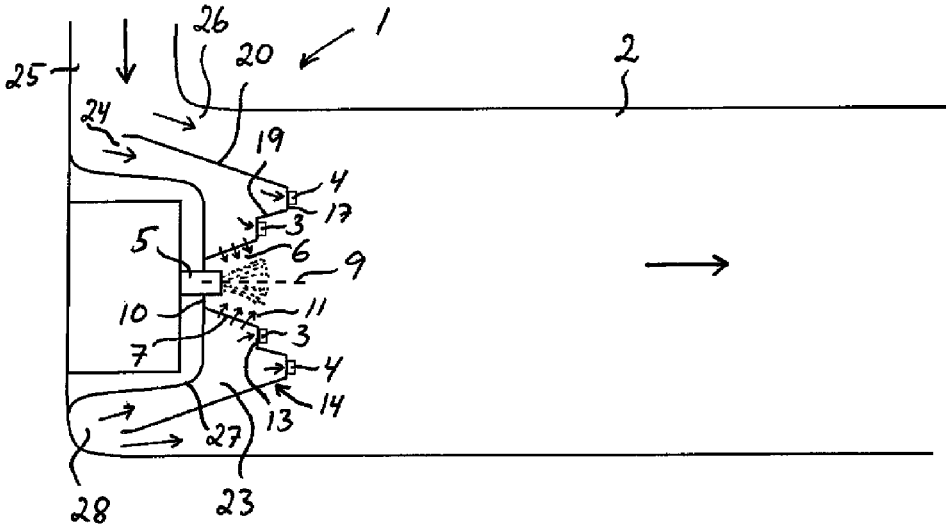
FIG. 1 is a schematic longitudinal section through an arrangement according to a first embodiment of the present invention.
Figure 4:
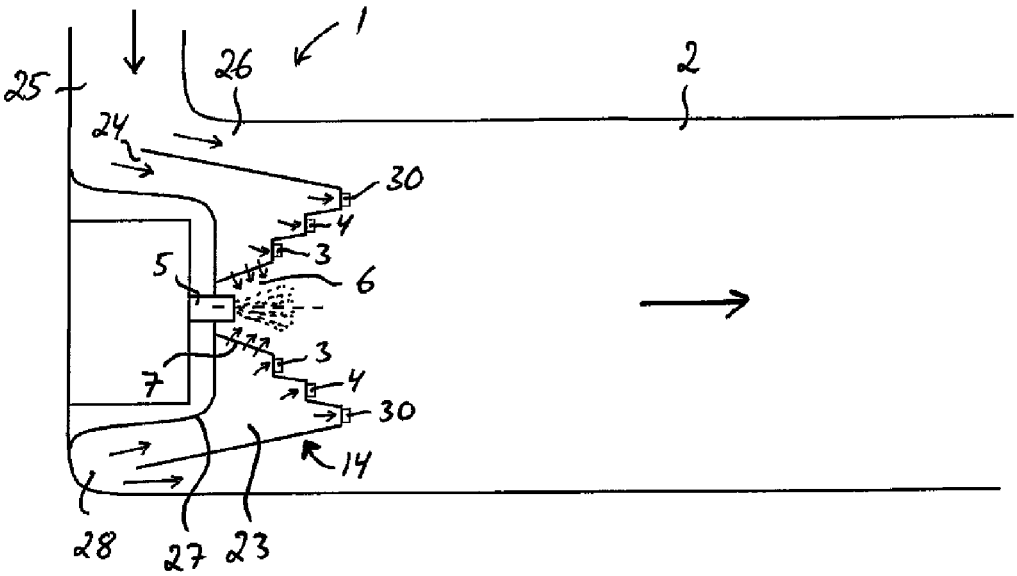
FIG. 4 is a schematic longitudinal section through an arrangement according to a second embodiment of the present invention.

FIGS. 1 and 4 illustrate two different embodiments an arrangement 1 for introducing a liquid medium into exhaust gases from a combustion engine. The arrangement may for example be situated in an exhaust line upstream of an SCR catalyst in order to introduce a liquid reducing agent in the form of urea or ammonia into the exhaust line upstream of the SCR catalyst, or be situated in an exhaust post-treatment device in order to introduce a liquid reducing agent in the form of urea or ammonia upstream of an SCR catalyst which forms part of the exhaust post-treatment device.

The arrangement 1 comprises a mixing duct 2 intended to receive at its upstream end exhaust gases from a combustion engine and to lead them towards an exhaust post-treatment unit, e.g. in the form of an SCR catalyst. The mixing duct 2 is thus intended to have exhaust gases flowing through it.

Figure 2:
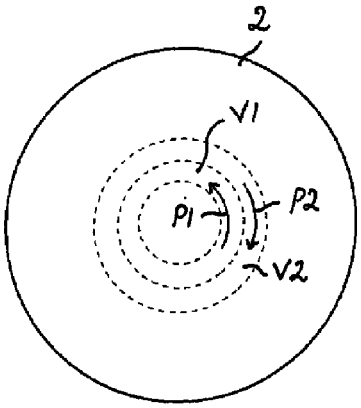
FIG. 2 is a schematic cross-section through the mixing duct of the arrangement according to FIG. 1.

The arrangement 1 further comprises a first flow guide 3 for creating a first exhaust vortex V1 (see FIGS. 2 and 5) in the mixing duct 2, a and second flow guide 4 for creating a second exhaust vortex V2 (see FIGS. 2 and 5) in the mixing duct 2 concentrically with and immediately external to the first exhaust vortex. The first flow guide 3 is arranged to cause the exhaust gases in the first exhaust vortex V1 to rotate in a first direction of rotation (indicated by the arrow P1 in FIG. 2) during their movement downstream in the mixing duct, and the second flow guide 4 is arranged to cause the exhaust gases in the second exhaust vortex V2 to rotate in a second direction of rotation (indicated by the arrow P2 in FIG. 2), which is opposite to said first direction of rotation, during their movement downstream in the mixing duct. The two exhaust vortices thus rotate in mutually opposite directions such that exhaust gases in the first exhaust vortex V1 will collide with exhaust gases in the second exhaust vortex V2, resulting in turbulent flow in the boundary region between the exhaust vortices.

The arrangement 1 further comprises an injector 5 configured to inject the liquid medium under pressure in the form of a finely divided spray into exhaust gases which are led into the mixing duct 2 in an exhaust flow at the centre of the first exhaust vortex V1. The injector 5 may for example comprise an injection nozzle.

Figure 3:
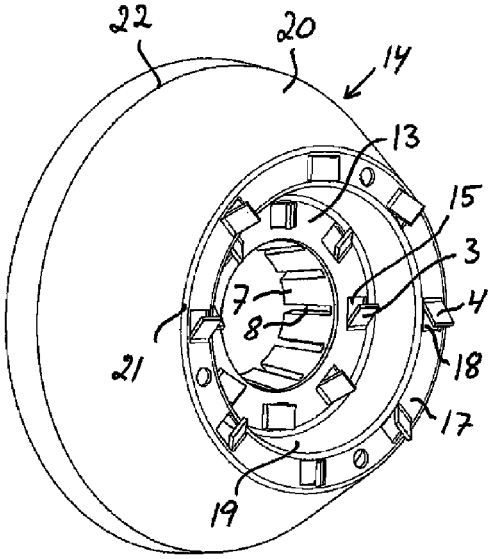
FIG. 3 is a schematic perspective view of parts of the arrangement according to FIG. 1.

In the embodiments illustrated in FIGS. 1 and 4, the arrangement 1 comprises an injection chamber 6 situated upstream of the mixing duct 2 and disposed to have exhaust gases flowing through it. This injection chamber 6 is connected to the mixing duct 2 in such a way that the exhaust gases received in the injection chamber 6 are led into the mixing duct 2 in an exhaust flow at the centre of the first exhaust vortex V1. The injector 5 is configured to inject the liquid medium into the injection chamber 6. The injection chamber 6 is bounded in radial directions by a casing 7 which is provided with throughflow casing apertures 8 (see FIG. 3) distributed in its circumferential direction in order to allow exhaust gases to enter the injection chamber 6 via these apertures 8. The apertures 8 are distributed symmetrically about the centreline 9 of the casing. Each aperture 8 may for example take the form of a slit extending in the axial direction of the casing, as illustrated in FIG. 3. The apertures 8 might have also have other alternative shapes. In the embodiments depicted, the casing 7 takes the form of a truncated cone which broadens towards the downstream end of the injection chamber.

In the embodiments illustrated, the injection chamber 6 has a closed rear end 10 and an open forward end 11. The chamber 6 is connected to the mixing duct 2 via its open forward end 11. The aforesaid casing 7 extends between the chamber's rear end 10 and its open forward end 11. The injector 5 is situated at the centre of the chamber's rear end 10 in order to inject the liquid medium towards the chamber's open forward end 11. In the examples illustrated, the injector 5 extends into the injection chamber 6 via its rear wall 10.

The first flow guide 3 may for example take the form of a set of first guide flaps situated at spacings from one another in a circle, as illustrated in FIG. 3. In the example illustrated, these guide flaps 3 are situated on a first annular surface 13 of a cowl 14 which is situated externally about the casing 7. The cowl 14 is connected to the forward end of the casing 7. The first annular surface 13 extends around the injection chamber's open forward end 11. The guide flaps 3 are evenly distributed around the centre of the first annular surface and each extend at an angle outwards across its respective throughflow aperture 15 in the first annular surface 13.

In the example illustrated, the second flow guide 4 takes the form of a set of second guide flaps situated at spacings from one another in a circle. In the example illustrated, these guide flaps 4 are situated on a second annular surface 17 of the cowl 14. The guide flaps 4 are evenly distributed around the centre of the second annular surface and each extends at an angle outwards across its respective throughflow aperture 18 in the second annular surface 17. In the example illustrated, the first guide flaps 3 are angled anticlockwise, whereas the second guide flaps 4 are angled clockwise. The second annular surface 17 is concentric with the first annular surface 13 and has a larger inside diameter than the outside diameter of the first annular surface 13. A wall 19 in the form of a truncated cone extends between the first annular surface 13 and the second annular surface 17. The cowl 14 further has an outer wall 20 connected at its forward end 21 to the outer edge of the second annular surface 17. This outer wall 20 takes the form of a truncated cone which broadens from the wall's forward end 21 upstream towards its rear end 22.

A gathering chamber 23 is situated between the casing 7 and the cowl 14. This chamber 23 surrounds the casing 7. The gathering chamber 23 has an inlet 24 for receiving exhaust gases from an exhaust line 25 and is connected to the injection chamber 6 via the casing apertures 8 in order to allow exhaust gases to flow into the injection chamber 6 from the gathering chamber 23 via these apertures 8. The gathering chamber 23 is also connected to the mixing duct 2 via the cowl apertures 15, 18 in order to allow exhaust gases to enter the mixing duct 2 from the gathering chamber 23 via these apertures 15, 18, resulting in the aforesaid exhaust vortices V1, V2.

In the embodiments illustrated, a bypass duct 26 is provided upstream of the mixing duct 2 to lead exhaust gases into the mixing duct without passing through the gathering chamber 23. The bypass duct 26 surrounds the gathering chamber 23 and is demarcated from it by the cowl 14. The bypass duct 26 surrounds, and extends along the outside of, the cowl 14.

The gathering chamber's inlet 24 is to divert part of the exhaust gases passing through the exhaust line 25 in order to allow these diverted exhaust gases to enter the gathering chamber 23, while the bypass line 26 is arranged to lead another portion of the exhaust gases passing through the exhaust line 25 directly into the mixing duct 2 in order to be mixed there with said diverted exhaust gases. The spray of liquid medium injected into the injection chamber 6 via the injector 5 comes into contact in the injection chamber 6 with exhaust gases which enter the injection chamber via the casing apertures 8 in a substantially symmetrical flow about this spray. The exhaust gases entering the injection chamber 6 prevent the liquid medium in said spray from coming into contact with the inside of the casing 7 and carry the liquid medium with them into the mixing duct 2, in which the liquid medium comes into contact with the exhaust vortices V1, V2, is broken up and spread out in the exhaust gases and is vaporised by their heat.

In the embodiments illustrated in FIGS. 1 and 4, the arrangement comprises a bulging portion 27 which has the casing 7 protruding from its upper side. The gathering chamber 23 is formed between this bulging portion 27, the casing 7 and the cowl 14. The inlet 24 of the gathering chamber is in this case annular and extends round the bulging portion 27. Upstream of the gathering chamber's inlet 24 the exhaust line 25 has an annular space 28 which extends around the bulging portion 27.

Figure 5:
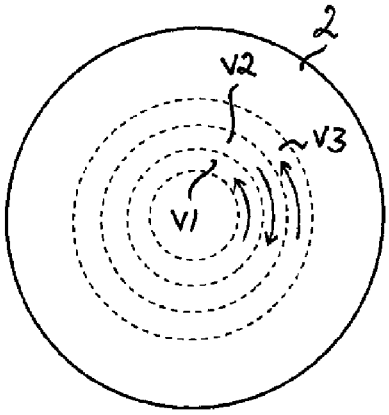
FIG. 5 is a schematic cross-section through the mixing duct of the arrangement according to FIG. 4.

In the embodiment illustrated in FIGS. 4 and 5, the arrangement 1 comprises also a third flow guide 30 for creating a third exhaust vortex V3 in the mixing duct 2 concentrically with and immediately externally about the second exhaust vortex V2. The third flow guide 30 is arranged to cause the exhaust gases in this exhaust vortex V3 to rotate in said first direction of rotation during their movement downstream in the mixing duct 2. The second and third exhaust vortices V2, V3 thus rotate in mutually opposite directions such that exhaust gases in the second vortex V2 will collide with exhaust gases in the third vortex V3, resulting in turbulent flow in the boundary region between the vortices. The third flow guide 30 may for example take the form of guide flaps of the type described above.

Where necessary, the arrangement may comprise further flow guides for creating any desired number of exhaust vortices in the mixing duct 2 concentrically with and externally about one another, such that alternate vortices are caused to rotate clockwise and the respective intermediate vortices anticlockwise.

The arrangement described herein is particularly intended for use in a heavy motor vehicle, e.g. a bus, a tractor vehicle or a truck.

The invention is of course in no way restricted to the embodiments described above, since many possibilities for modifications thereof may be adopted by a specialist in the field without having to deviate from the invention's basic concepts. For example, the flow guides 3, 4, 30 may be configured differently from what is described above.

The invention claimed is:

1. An arrangement for introducing a liquid medium into exhaust gases from a combustion engine, which arrangement comprises a mixing duct for carrying said exhaust gases flowing through it, a casing having a plurality of apertures, a first flow guide for creating a first exhaust vortex in the mixing duct, said first flow guide being configured to cause the exhaust gases in said first vortex to rotate in a first direction of rotation during their movement downstream in the mixing duct, an injector for injecting the liquid medium in the form of a finely divided spray into the exhaust gases which are led into the mixing duct in an exhaust flow centrally of the first vortex, an injection chamber, situated upstream of the mixing duct, for carrying said exhaust gases flowing through it and connected to the mixing duct so that the exhaust gases received in the injection chamber are led into the mixing duct in said exhaust flow centrally of the first vortex, an outer wall connected to the casing to define a gathering chamber to surround the casing and an inlet to permit exhaust gases to enter the gathering chamber and then enter the injection chamber via the apertures, wherein the injector is arranged to inject the liquid medium into the injection chamber; the arrangement further comprising a second flow guide for creating a second exhaust vortex in the mixing duct concentrically with and externally about the first vortex, which second flow guide is configured to cause the exhaust gases in this second vortex to rotate in a second direction of rotation, which is opposite to said first direction of rotation, during their movement downstream in the mixing duct, wherein the first flow guide comprises a plurality of first guide flaps situated at a spacing from one another in a circle on the casing, wherein each first guide flap is located adjacent a respective aperture that feeds exhaust gases into said mixing duct, wherein said injection chamber has a closed rear end and an open forward end located upstream of said first and second flow guides, and wherein said injector is situated in the closed rear end to inject liquid medium toward said open forward end.

2. An arrangement according to claim 1, wherein the injection chamber is bounded radially by the casing and the apertures are distributed circumferentially.

3. An arrangement according to claim 2, wherein the apertures are distributed symmetrically about the centreline of the injection chamber.

4. An arrangement according to claim 3, wherein the injector is situated centrally of the injection chamber's rear end.

5. An arrangement according to claim 1, wherein, the second flow guide comprises a plurality of second guide flaps situated at a spacing from one another in a circle on the casing, each second guide flap being adjacent a respective aperture.

6. An arrangement according to claim 1, wherein the arrangement further comprises a third flow guide for creating a third exhaust vortex in the mixing duct concentrically with and externally about the second vortex, which third flow guide is configured to cause the exhaust gases in the third vortex to rotate in said first direction of rotation during their movement downstream in the mixing duct.

7. An arrangement according to claim 2, wherein the injector is situated centrally of the injection chamber's rear end.

* * * * *